US006457443B1

(12) United States Patent
Lillbacka

(10) Patent No.: US 6,457,443 B1
(45) Date of Patent: Oct. 1, 2002

(54) VALVELESS ROTATING CYLINDER INTERNAL COMBUSTION ENGINE

(75) Inventor: Jorma Lillbacka, Kauhava (FI)

(73) Assignee: Lillbacka Powerco Oy, Harma (FI)

( * ) Notice: Subject to any disclaimer, the term of this patent is extended or adjusted under 35 U.S.C. 154(b) by 0 days.

(21) Appl. No.: 09/846,387

(22) Filed: May 2, 2001

Related U.S. Application Data

(62) Division of application No. 09/161,315, filed on Sep. 28, 1998, now Pat. No. 6,240,884.

(51) Int. Cl.[7] ..... F02B 57/04
(52) U.S. Cl. ..... 123/44 D
(58) Field of Search ..... 123/44 C, 44 D

(56) References Cited

U.S. PATENT DOCUMENTS

| | | | | | |
|---|---|---|---|---|---|
| 1,180,393 | A | * | 4/1916 | Hall | 123/44 D |
| 2,242,231 | A | * | 5/1941 | Cantoni | 123/44 D |
| 4,136,646 | A | * | 1/1979 | Lappa | 123/44 C |
| 4,407,239 | A | * | 10/1983 | Wass | 123/44 C |
| 6,148,775 | A | * | 11/2000 | Farrington | 123/44 C |

* cited by examiner

*Primary Examiner*—Michael Koczo
(74) *Attorney, Agent, or Firm*—Louis Woo

(57) ABSTRACT

An efficient and powerful engine is obtained by incorporating within an engine housing at least one cylinder which is rotatable along the inner circumferential surface of the housing. The cylinder is mounted to a crank case. A piston rod extends from the piston and is moveable longitudinally within the cylinder. The piston rod in turn is connected to a crankshaft. Thus, when the engine is powered, both the cylinder and the crankshaft can rotate, either in the same direction or in opposite directions. An exhaust opening is provided at a location substantially at the top portion of the cylinder. A corresponding exhaust port is provided in the housing, so that when the cylinder is rotated to the particular location along the housing, its exhaust opening comes into alignment with the exhaust port of the housing so that the exhaust gases resulting from the combustion in the cylinder are evacuated directly outside of the housing. A gear mechanism converts the rotational movement of either the cylinder, the crankshaft, or a combination of both, to drive the vehicle, or power generating device, to which the engine is adapted.

33 Claims, 12 Drawing Sheets

VALVELESS ROTATING CYLINDER INTERNAL COMBUSTION ENGINE

This application is a division of application Ser. No. 09/161,315, filed Sep. 28, 1998, now U.S. Pat. No. 6,240,884.

FIELD OF THE INVENTION

The present invention relates to internal combustion engines and more particularly to a valveless engine that is efficient to operate and adaptable to be used with all types of vehicles.

BACKGROUND OF THE INVENTION

A conventional internal combustion engine in most instances does not operate efficiently, as a large portion of fuel is not burnt during combustion. This is particularly true with two cycle engines, which tend to get hot and operate inefficiently due to the exhaust gases not being able to be sufficiently evacuated from the chamber of the cylinders. Furthermore, the inputting of gas into the conventional engines is inefficient inasmuch as the conventional gas cylinders tend to have a gas intake valve at approximately the same line of reference as the exhaust valve. Consequently, after combustion, the exhaust gases at the top of the cylinder are not fully evacuated, thus leading to inefficiency.

Attempts have been made by engine manufacturers in their quest to come up with a more efficient engine. One such engine is the Wankel engine in which a triangular shaped rotor rotates within the engine chamber. But because of its shape, and the way in which the rotor rotates within the chamber, such Wankel engine tends to get very hot and the engine has a tendency to warp.

A need therefore exists for an internal combustion engine that can evacuate efficiently the exhaust gases resulting from combustion therein.

Further, in a conventional two stroke engine, one work cycle is produced when the crankshaft is rotated 360°. This is inefficient for those vehicles that are best adapted to use such two stroke engines.

A further need therefore arises for an engine that has a higher efficiency in terms of the RPM that it can generate, as compared to prior art engines. Putting it differently, there is a need for an engine that can operate at a higher efficiency and increased power due to an increased number of work cycles without increasing the RPM of the engine

SUMMARY OF INVENTION

In a conventional internal combustion engine, the cylinders are fixed and only the crankshaft moves. The present invention differs from the conventional internal combustion engines in that its cylinders are movable relative to the crankshaft. Moreover, the instant invention engine requires no valves, as compared to a conventional internal combustion engine which requires both a cam shaft and various valves for controlling the input of fuel and the output of exhaust gases. For the instant invention, exhaust gases are evacuated from the cylinder only when the exhaust opening of the cylinder is positioned in alignment with the exhaust port of the housing. Thus, no valves are required to open or close the exhaust opening of the cylinder or the exhaust port of the housing.

In particular, the instant invention engine has a housing which may have an inner circumferential surface. Within the housing is a crank case having coupled thereto at least one cylinder. A piston is movably fitted in the cylinder, with a piston rod extending therefrom. The piston rod in turn is coupled to a crankshaft, so as to be rotatable with the reciprocal movement of the piston within the cylinder.

In one aspect of the instant invention, the head of the cylinder is configured so as to be rotatable along the inner circumferential surface of the housing so that as it rotates relative to the crankshaft, it moves along the path defined by the inner circumferential surface of the housing. An exhaust opening is provided at an upper portion of the cylinder while an exhaust port is provided at a given location of the housing so that when the cylinder is rotated to that particular location, its exhaust opening mates with the exhaust port of the housing, to thereby evacuate the exhaust gases resulting from the combustion of fuel/air mixture within the cylinder. To control the amount of exhaust gases being evacuated, and therefore controlling the power output from the engine, a closure mechanism is used to control the size of the exhaust port of the housing. To prevent backdraft, another closure mechanism is provided to the cylinder for closing its exhaust opening when it no longer mates with the exhaust port of the housing.

In a second aspect of the instant invention engine, instead of rotating along a predefined path as defined by the inner circumferential surface of the housing, the crankshaft of the instant invention engine is fixedly mounted to the housing. Accordingly, the cylinder rotates about the crankshaft as a result of the reciprocating movement of the piston. Thus, the rotation of the cylinder is defined, even without being guided by the inner circumferential surface of the housing.

To enhance the evacuation of the exhaust gases from the cylinder, unlike conventional internal combustion engines, the instant invention engine, at least with respect to its two cycle version, has its gas inlet port located at the lower portion of the cylinder while its exhaust port located at its upper portion. As a result, as evacuation of exhaust gases goes on, the fuel/air mixture being fed into the cylinder helps to push the exhaust gases out of the cylinder. With less exhaust gases in the chamber of the cylinder and the chamber being filled with more fuel, a more powerful combustion process takes place.

Inasmuch as the cylinder and the crankshaft of the instant invention engine are both rotatable, by rotating the crankshaft in an opposite direction to the rotation of the cylinder, the instant invention engine is able to increase the number of work cycles for a given number of revolutions, thereby increasing its power output. To further increase the power output, additional cylinders may be provided within the same housing. Alternatively, a number of housings each of which contains at least one cylinder may be workingly cascaded together to the same crankshaft.

It is therefore an objective of the present invention to provide an engine that does not require any valves for controlling the evacuation of exhaust gases.

It is another objective of the present invention to provide an internal combustion engine that does not require any valves for the input of fuel thereinto.

It is yet another objective of the present invention to provide an engine that has a higher performance efficiency than a similarly sized conventional engine.

It is still another objective of the present invention to provide an engine with increased work cycles but rotates at the same number of revolutions per period of time as a similarly sized conventional internal combustion engine.

BRIEF DESCRIPTION OF THE DRAWINGS

The above-mentioned objectives and advantages of the present invention will become apparent and the invention itself will be best understood by reference to the following description of an embodiment of the invention taken in conjunction with the accompanying drawings, wherein:

FIG. 13 is a perspective view of an exemplar crankshaft of the instant invention and a piston rod attached thereto;

DETAILED DESCRIPTION OF THE INVENTION

Figure 1:
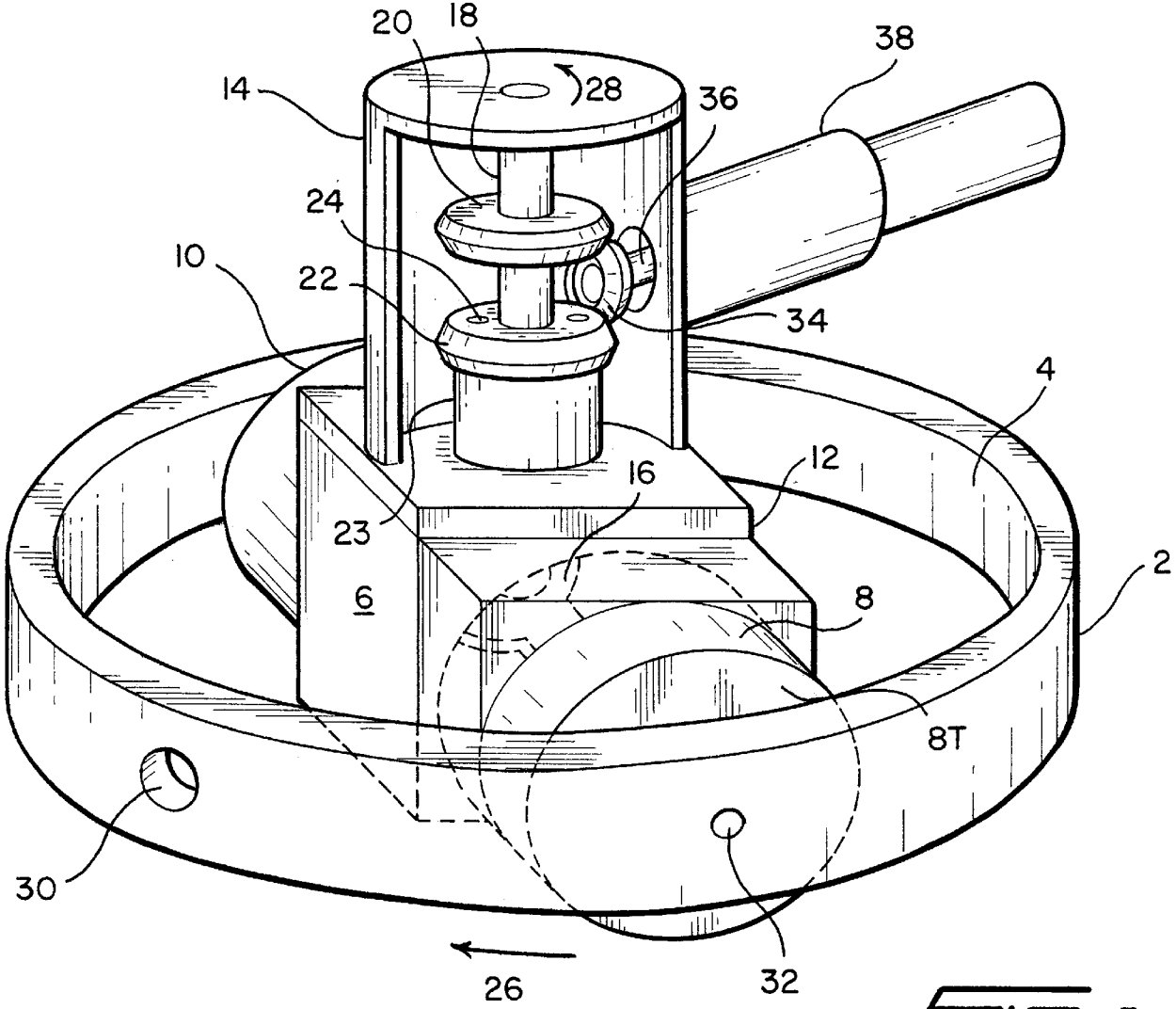
FIG. 1 is a semi-exposed perspective view of the engine of the instant invention.

With reference to FIG. 1, a semi-exposed perspective view of the engine of the instant invention is shown. As illustrated, the engine has a housing 2 that has a substantially inner circumferential surface 4. Within housing 2 there is a crank case 6 which has mounted thereto two cylinders 8 and 10. In place of two cylinders, it should be appreciated that the instant invention engine is operable with only one cylinder, so long as it is balanced when it moves about the inside of housing 2. So, too, more than two cylinders could be mounted within housing 2.

Coupled to crank case 6 is a frame or frame support 12 which has coupled thereto a gear box or gear housing 14. As shown by the dotted line, there is extending from cylinder 8 a piston rod 16, which, although not shown with particularity in this figure, has connected thereto a crankshaft 18. Fixedly coupled to crankshaft 18 is a first driving wheel 20 that is supported by a bearing, not shown, in bearing housing 23. Bearing housing 23 in turn has coupled thereto a second driving wheel 22 by means of a number of bolts 24. Bearing housing 23 in fact can be integrated to support 12 or can be bolted thereto. Support 12 is fixedly mounted to crank case housing 6 which, as mentioned previously, has fitted thereto cylinders 8 and 10.

Cylinder 8 (and also cylinder 10) has a head or top portion 8T that is configured to moveably fit along the inner circumferential surface 4 of housing 2, so that it can rotate thereabout. Since cylinder 8, as well as cylinder 10, is coupled to crank case 6, which in turn is coupled to support 12, with bearing housing 23 and gear 22 connected thereto, driving wheel 22 rotates independently of driving wheel 20, which rotates when crankshaft 18 rotates. Simply put, crankshaft 18 rotates independently of the rotation of cylinder 8 about inner circumference surface 4 of housing 2. Thus, depending on the configuration of the crank shaft shown in FIG. 13, cylinder 8 may in fact rotate in a direction opposite to that of crankshaft 18. For example, cylinder 8 may rotate in the clockwise direction as indicated by directional arrow 26 while crankshaft 18 may rotate in the opposite direction as indicated by directional arrow 28.

Further shown in the engine of FIG. 1 is an opening 30 which, to be discussed later, is an exhaust port. Cylinder 8 likewise has an opening 32 that comes into alignment with exhaust port 30 when cylinder 8 is rotated to the appropriate location along inner circumferential surface 4.

Further shown in gear box 14 of FIG. 1 is a wheel 34 that meshes with both driving wheels 20 and 22. Wheel 34 is a synchronizing wheel in that it provides synchronization for both driving wheels 20 and 22. The operation and interrelationship between the wheels in gear box 14 will be discussed further, infra. Suffice it to say for the time being that a drive shaft 36 is fixedly coupled to wheel 34 and is driven thereby. It is by means of this drive shaft 36 that power is provided to the vehicle to which the engine of FIG. 1 is installed. A housing 38 extends from gear housing 14 to protect drive shaft 36.

Figure 2:
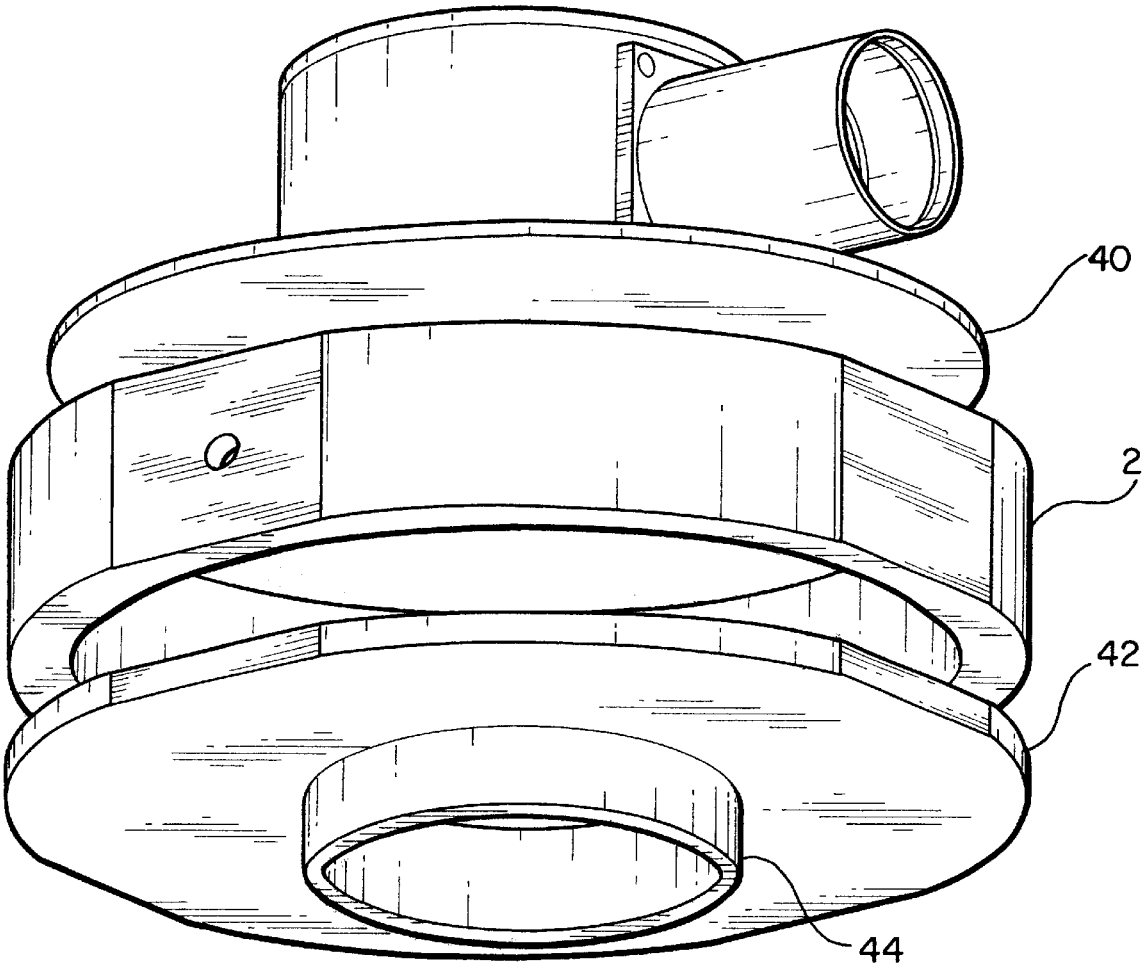
FIG. 2 is an exposed view of the housing of the instant invention engine.

FIG. 2 is an exposed view of the different pieces that make up the housing of the instant invention engine. As shown, a cover plate 40 (which may be an extension of support 12 of FIG. 1), to which gear housing 14 is mounted, is positioned and removably coupled to housing 2. On the opposed side of housing 2 there is a second cover plate 42 coupled to housing 2. An opening is defined in plate 42 by a circumferential lip 44.

Figure 3:
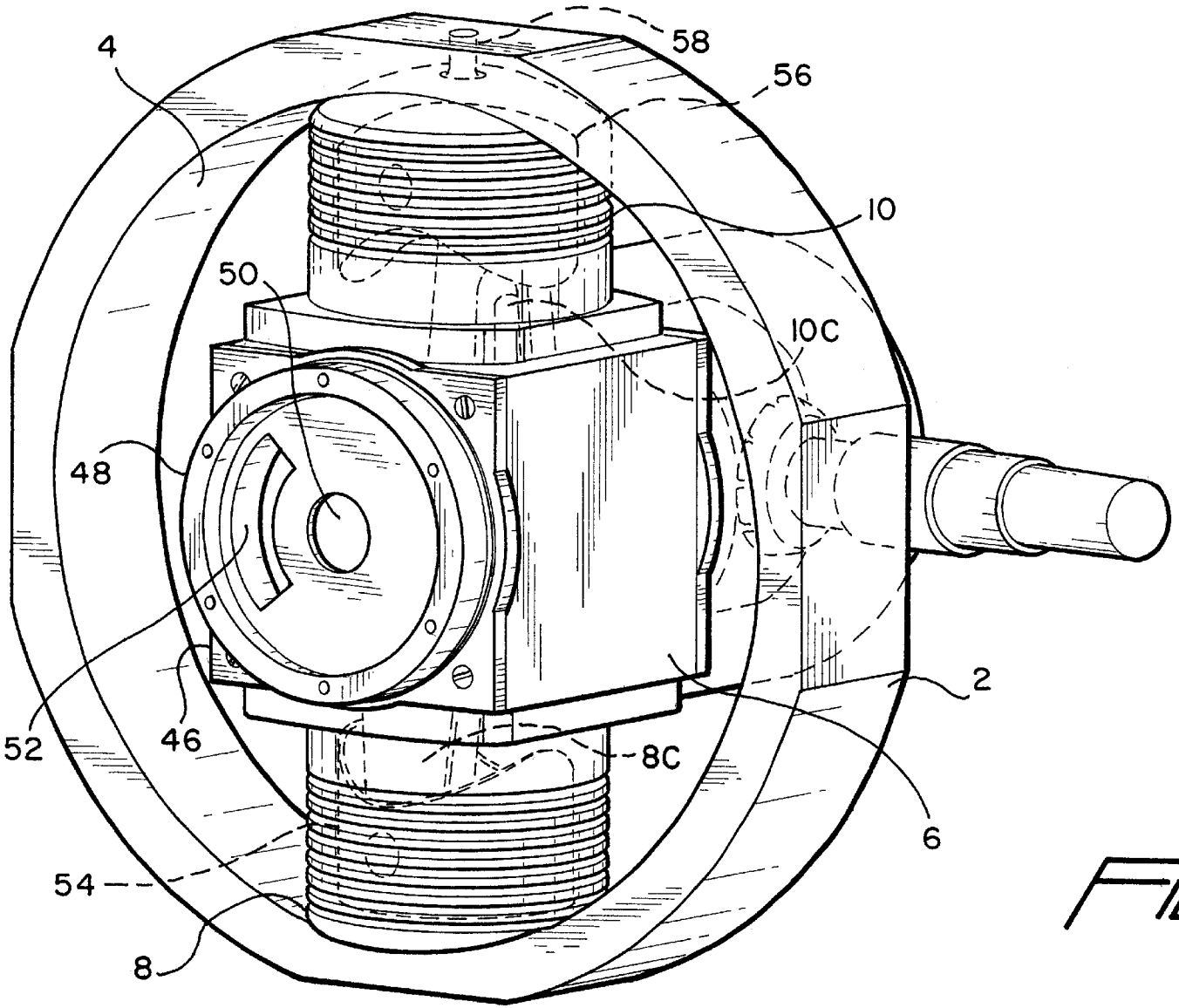
FIG. 3 is a perspective view of the present invention viewed from the bottom of the engine.

The reason for the opening defined by lip 44 is better illustrated with respect to FIG. 3. There, a perspective view of the engine, with plates 40 and 42 removed, is shown. Looking at the underside of crank case 6, it can be seen that there is coupled thereto an extension plate 46. Bolted to extension plate 46 is a circular plate 48 having a center hole 50 where one end of crankshaft 18 is mounted. There is also an opening 52 provided in plate 48 through which fuel which may be in the form of an air/fuel mixture is input to crank case 6. The dimension of opening 52 can be configured to accept any fuel delivery devices such as for example a carburetor or a fuel injection device, coupled to plate 48.

Figure 12A:
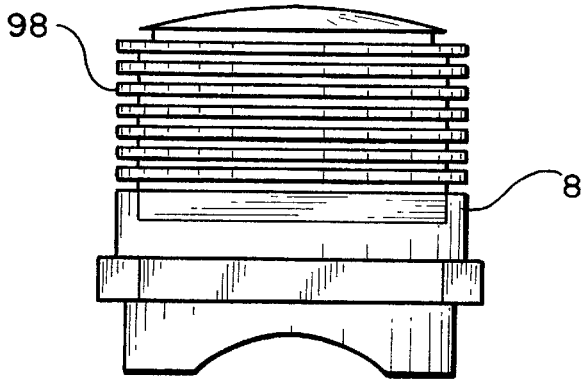
FIG. 12*a* is a side view of an exemplar cylinder.
Figure 12B:
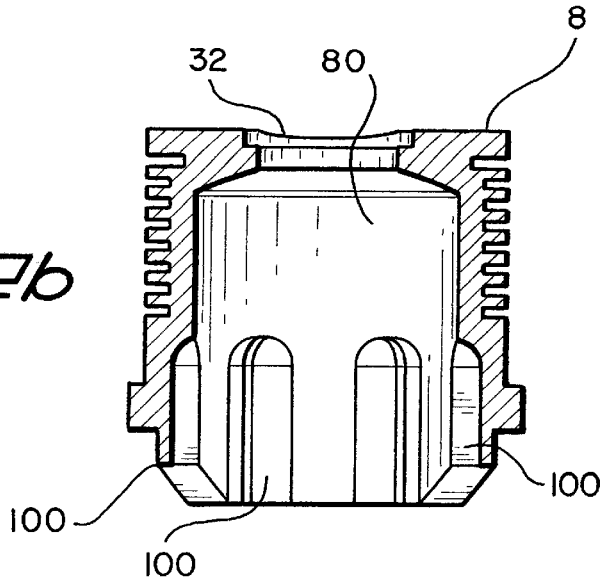
FIG. 12*b* is a cross-sectional view of the FIG. 12*a* cylinder.
Figure 12C:
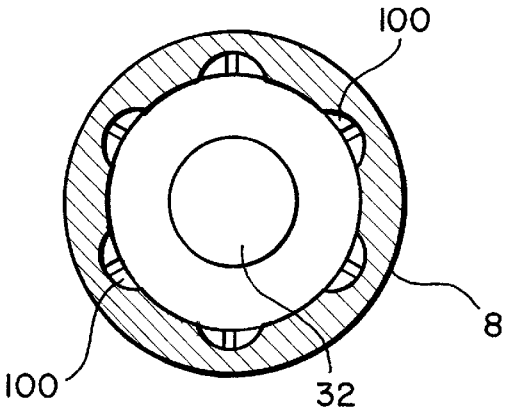
FIG. 12*c* is a cross-sectional bottom view of the FIG. 12*a* cylinder showing in particular the various channels whereby fuel is supplied internally to the cylinder for combustion.

Per the perspective view of FIG. 3, a better view of cylinders 8 and 10 are shown. For ease of illustration, cylinders 8 and 10 are each shown in only an outline format so that the respective pistons 54 and 56 within the cylinders can be seen. There is moreover shown a channel, or grooves 8*c* and 10*c*, in cylinders 8 and 10, respectively. Channels 8*c* and 10*c*, as will be discussed in more detail with respect to FIGS. 12*a* and 12*c*, provide a passageway for the fuel input through opening 52 to crank case 6 to be routed to the interior of the cylinders past pistons 54 and 56, respectively. This is provided that the position of the piston, with respect to the cylinder, is such that the top portion of the channel is above the piston. In other words, once a piston, such as for example 56, is moved or positioned past the top edge of channel 10*c*, the fuel mixture in crank case 6 no longer is fed to the interior of cylinder 10. There is moreover shown a spark plug 58 mounted to the top portion of cylinder 10. The location of spark plug 58 can vary, depending on the exhaust opening, such as 32 shown in FIG. 1, of the cylinder.

As best shown in FIG. 3, note that cylinders 8 and 10 are in contact with inner circumferential surface 4 of housing 2 so that those cylinders are rotatable along surface 4. Further note that even though the heads of cylinders 8 and 10 each appear to be flat so as to mate with the inner circumferential surface of the "ring" shaped housing, in practice, the shape of the heads of the cylinders, as well as the inner circumferential surface of the housing, can be spherical (or any other matching shapes) so that good sealing between the cylinders and the inner surface of the housing is achieved.

Figure 4:
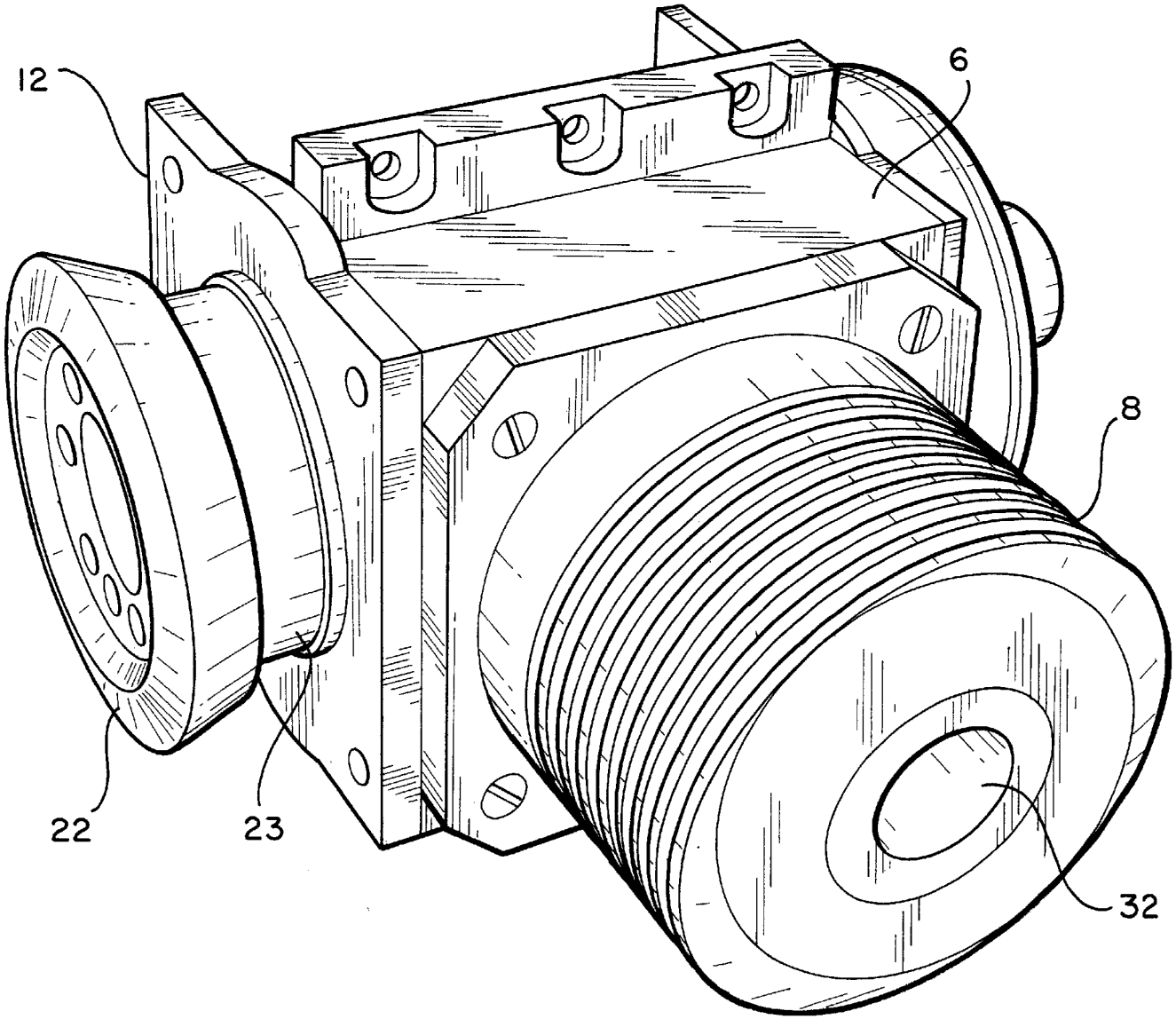
FIG. 4 is a perspective view of a portion of the crank case and one cylinder of the instant invention engine.

FIG. 4 shows a portion of crank case 6 and a cylinder (assume it is cylinder 8) mounted thereto. Further shown mounted to crank case 6 is support 12 to which is mounted bearing housing 23. Bolted to bearing housing 23 is driving wheel 22. As best shown in FIG. 4, at the top of cylinder 8 is opening 32 through which exhaust gases resulting from combustion having taken place in the interior of cylinder 8 are evacuated. Although not shown in FIG. 4, it should be appreciated that a closure mechanism, such as for example that shown in FIG. 9, would close opening 32 when it is not desirable to evacuate the exhaust gases so that there is no backdraft for cylinder 8. Further, note that even though exhaust opening 32 is shown to be located at the top of cylinder 8, in actuality, such exhaust opening can be located anywhere along the upper portion of cylinder 8. More elaboration of that later with respect to FIGS. 10 and 11.

The last thing to note with respect to the FIG. 4 illustration is that wheel 22 is fixedly bolted to bearing housing 23, which in turn is bolted by means of support 12 to crank case 6. And insofar as cylinder 8 is fixedly coupled to crank case 6, when cylinder 8 rotates relative to crankshaft 18, shown as for example in FIG. 1, wheel 22 will rotate in the same direction as cylinder 8. Thus, in a two cycle engine with crankshaft 18 fixedly coupled to a frame, the only thing that rotates is the cylinder, for example cylinder 8 in the exemplar embodiment of FIG. 4. Thus, wheel 22 becomes the driving wheel for providing the power to drive the vehicle, or other power driven device such as for example a generator, to which the engine of FIG. 4 is mounted.

Figure 5:
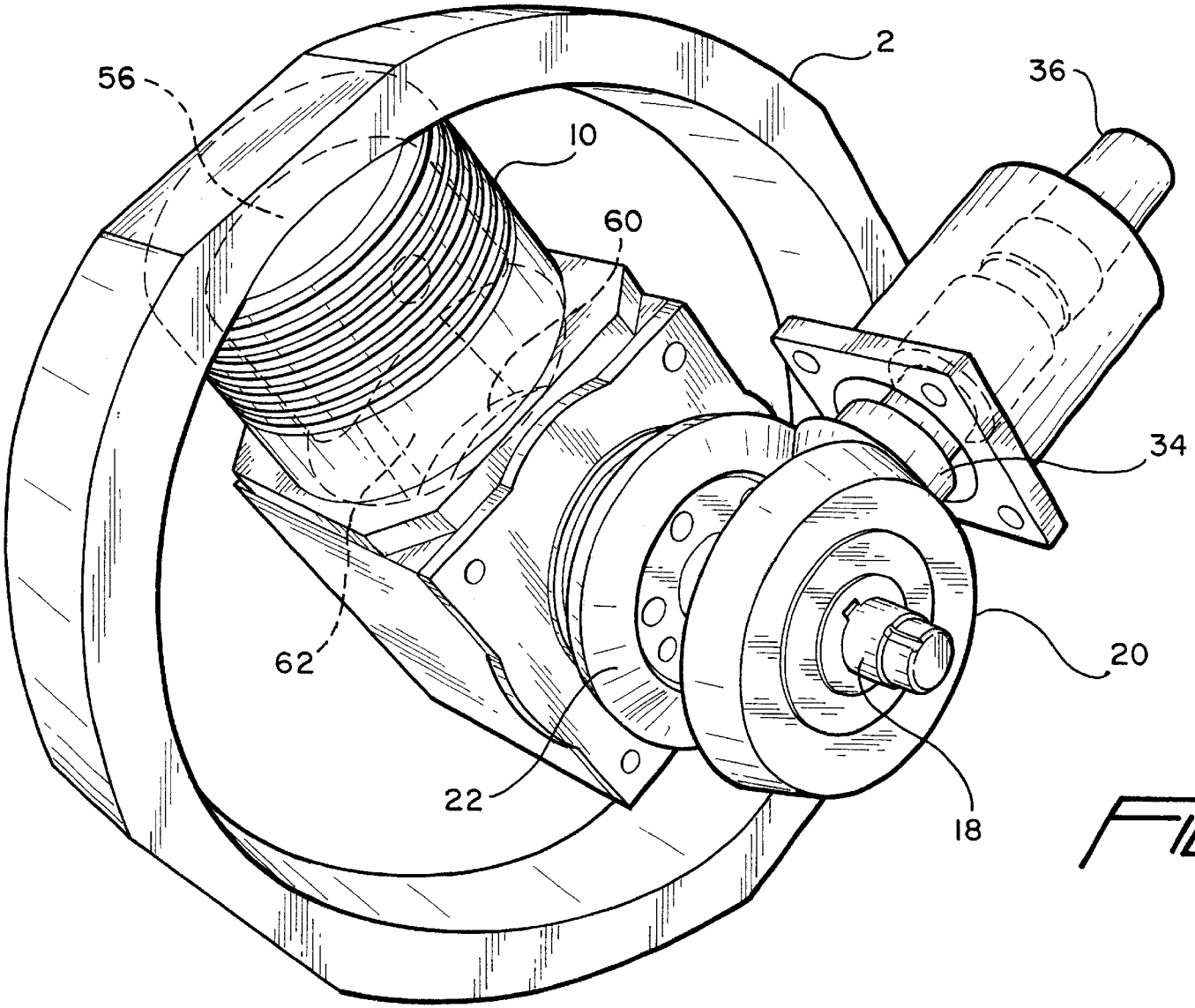
FIG. 5 is a perspective view of the instant invention engine viewed from the top.

FIG. 5 is a perspective view of the engine of the instant invention as viewed from the top. As shown, synchronizing wheel 34 meshes with each of wheels 22 and 20 and is driven thereby for driving drive shaft 36. Crankshaft 18, to which wheel 20 is fixedly coupled, extends through wheel 22 into crank case 6 and is coupled to a cam shaft 60, a portion of which is shown to be coupled to piston rod 62, which in turn extends from piston 56.

Figure 6:
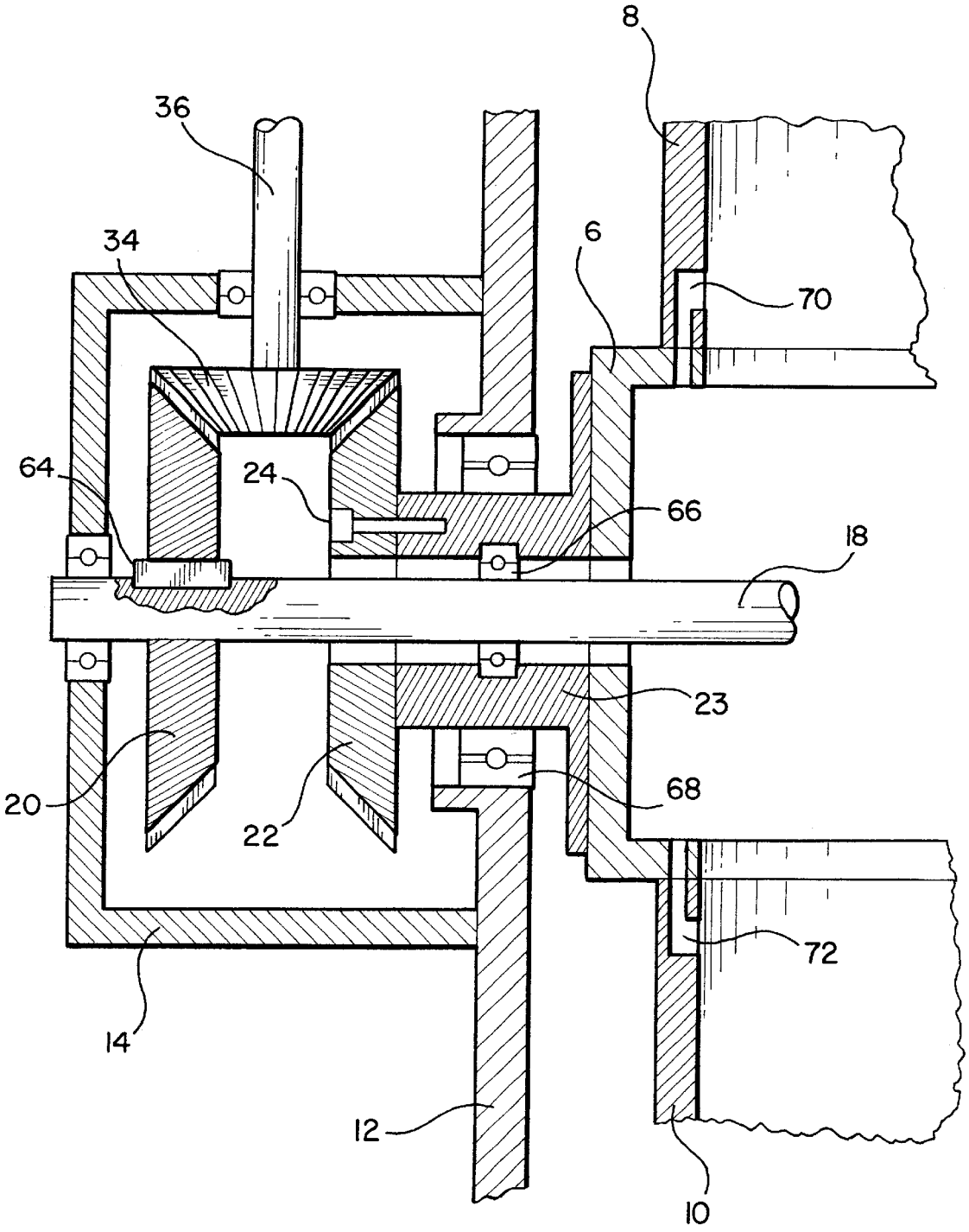
FIG. 6 is a cross-sectional view of the instant invention engine showing in particular the gear mechanism thereof.

A more detailed illustration of the interaction between crankshaft 18, wheels 22 and 20, and synchronizing wheel 34 is shown in the cross-sectional view of FIG. 6. There, crankshaft 18 is shown to extend from crank case 6 through bearing housing 23 and wheel 22, so as to be rotatably mounted to a frame of the engine, in this case gear housing 14. As shown, wheel 20 is fixedly coupled to crankshaft 18 by means of an insert 64. Wheel 22 in turn is bolted to bearing housing 23 by means of a number of bolts represented for example by bolt 24. Inside bearing housing there is a roller bearing 66 for supporting crankshaft 18. Bearing housing 23 in turn is supported by a bearing 68, so that it can rotate relative to support 12. Thus, when crankshaft 18 rotates, only wheel 20 is rotated therewith.

On the other hand, when cylinders 8 and 10 rotate about inner circumferential surface 4 of housing 2, crank case 6 is rotated therewith. This means bearing housing 23, which is coupled to crank case 6, is likewise rotated. And when bearing housing 23 rotates, wheel 22 likewise rotates in the same direction. As a consequence, for the instant invention engine, given the fact that the piston rods from the cylinders are mounted to crankshaft 18, depending on which direction crankshaft 18 is driven and the rotation of the cylinders relative to the rotation of crankshaft 18, the cylinders and crankshaft 18 can either rotate in the same direction or rotate in opposite directions. This ability of the cylinders to rotate in the direction opposite to that of the crankshaft provides the engine of the instant invention the capability of increasing the speed, and therefore the power of the engine, without having to increase the RPM, or the operational load, of the engine. This is done by interposing synchronizing wheel 34 between driving wheels 22 and 20.

Specifically, synchronizing wheel 34 can be considered as an RPM control wheel that rotates at a speed that is a combination of the rotational speeds of wheels 22 and 20. The important aspect of synchronizing wheel 34, as its name implies, is that it can provide synchronization for both wheels 22 and 20. Moreover, given that the cylinders 8 and 10 can rotate in a direction opposite to that of crankshaft 18 and that wheel 20 is driven by crankshaft 18 while wheel 22 is driven by the rotation of cylinders 8 and 10, the fact that synchronizing wheel 34 meshes with both wheels 22 and 20 means that synchronizing wheel 34 is driven at a speed that is greater than the speed of either one of wheels 22 or 20. In fact, the size of wheel 34 can be dimensioned such that it rotates twice (or more) for every rotation of either one of wheels 22 and 20, which for the embodiment shown in FIG. 6 is configured to have the same size. Thus, drive shaft 36, which is fixedly coupled to wheel 34 and is therefore driven thereby, rotates at the speed of wheel 34.

For the embodiment shown in FIG. 6, it is assumed that the vehicle to which the engine of the instant invention is mounted is driven by drive shaft 36. Yet with the instant invention engine, the engine can be mounted in such a way that the vehicle could be driven by crankshaft 18, if crankshaft 18 is extended beyond gear housing 14. This secondary power source of the instant invention is useful insofar as it enables the instant invention engine to be adaptable to be used for things other than vehicles, such as for example power generators or other devices that are to be power driven, or devices that require more than one source of rotational power.

Note that wheels 22 and 20 are of the same size. Accordingly, they have a 1 to 1 ratio. Thus, for every revolution of the cylinders 8 and 10, there are two work cycles. The ratio of wheels 22 and 20 can be changed by providing additional spark plugs and exhaust ports to housing 2. For example, wheel 22 can be turned at a greater rate than the rotation of crankshaft 18, so that a different ratio can be created between wheels 22 and 20. If there is indeed a different gear ratio between wheels 22 and 20, then a different gear system is required. In addition to increasing the number of firing mechanisms such as for example spark plugs and exhaust ports, additional cylinders may be provided within housing 2.

One more thing to take note of in FIG. 6 is the respective inlet ports 70 230 and 72 for providing the fuel input to crank case 6 to cylinders 8 and 10, respectively. A more detailed discussion with respect to how the fuel is provided to the interior of cylinders 8 and 10 will be given with respect to the configuration of the cylinders as shown in FIGS. 12*a*–12*c*.

Figure 7:
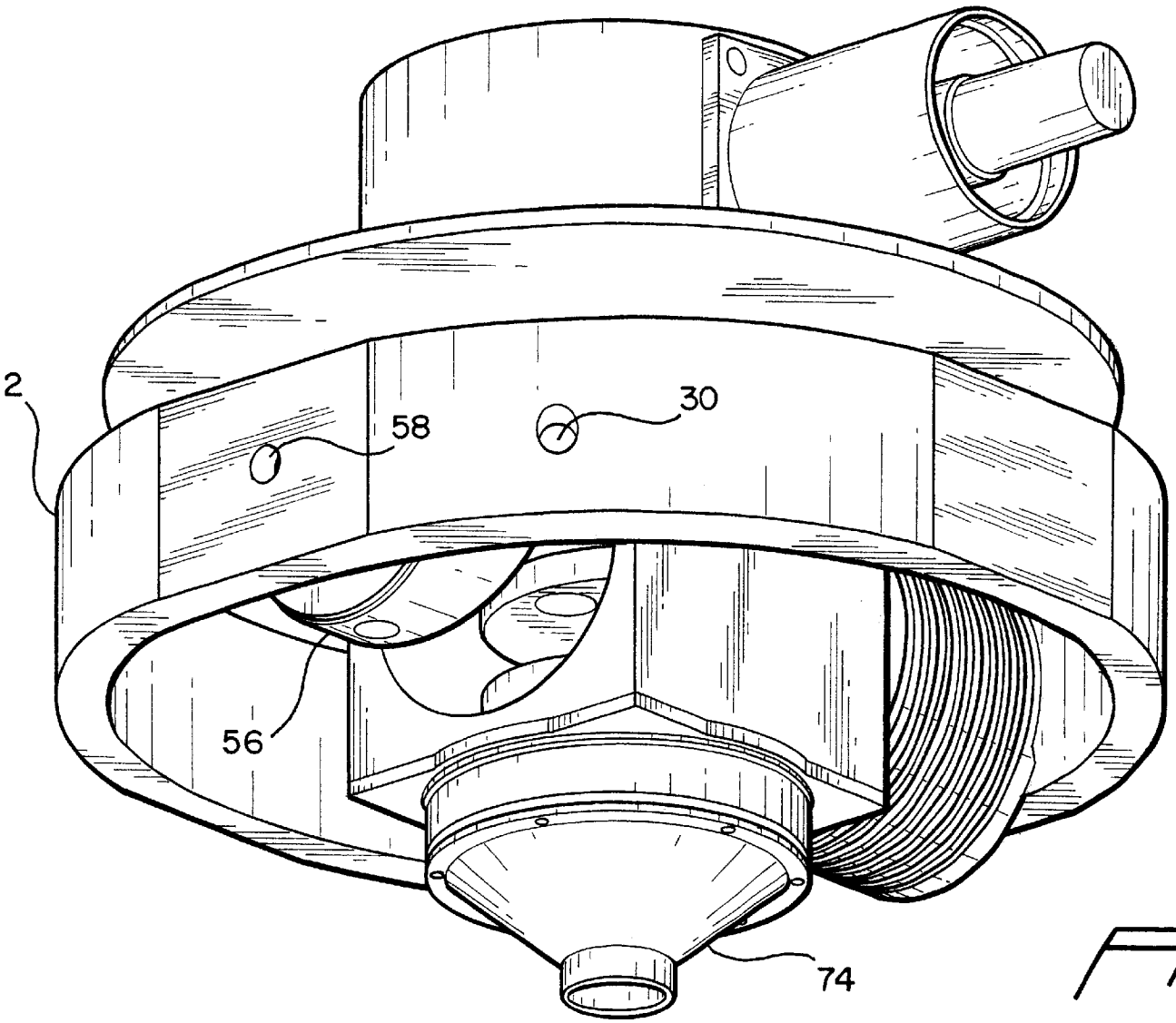
FIG. 7 is yet another exposed perspective view of the instant invention engine.

FIG. 7 is an exposed perspective view of the engine of the instant invention which shows a firing device such as for example a spark plug 58 fitted to housing 2. For the sake of simplicity and understanding, the housing of the cylinder has been removed from the FIG. 7 view so that only piston 56 is shown. Further shown is exhaust port 30 in housing 2 through which combustion gases in this cylinder can escape when the cylinder is rotated to the appropriate place along the circumferential side surface 4 of housing 2. The last thing that should be taken notice of in FIG. 7 is the protective cap 74 mounted over extension plate 48 for protecting the carburetor or fuel injection device mounted thereto.

Figure 8:
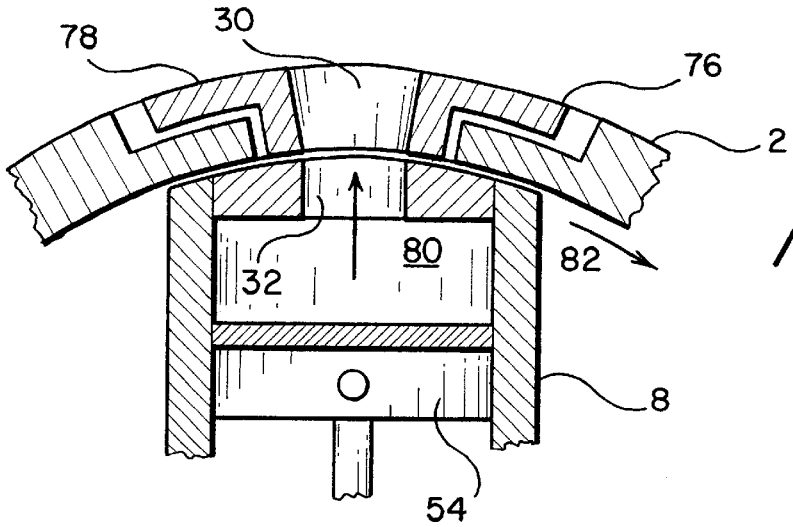
FIG. 8 is a cross-sectional view showing the relationship between the opening of the cylinder and the exhaust port of the housing, and further shows the mechanism for adjusting the dimension of the exhaust port of the housing.

FIG. 8 illustrates how to increase/decrease the power of the engine by retarding or advancing the timing of the engine. Specifically, by providing two components, namely an exhaust leading edge adjustment component 76 and an exhaust trailing edge adjustment component 78, to exhaust port 30 of housing 2, the size of the exhaust port opening can be varied for controlling the timing and the amount of exhaust gases to be evacuated from chamber 80 of cylinder 8, when piston 54 is moving in the direction as shown by the arrow. By constricting the evacuation of the exhaust gases in chamber 80, the gases in the chamber will be burned more completely before being evacuated. Accordingly, more power is generated and a cleaner engine results.

Assume cylinder 8 is rotating in the direction indicated by arrow 82. For the FIG. 8 exemplar embodiment, leading edge component, which is a closure flap, can be adjusted either independently under the control of a processor, or manually by the operator on the fly, as the engine is being used. By first decreasing the size of opening 30, a back pressure is built up in chamber 80 so that exhaust gases are burnt more efficiently. And as the RPM goes up in the engine, in the case where the operator is manually adjusting components 76 and 78, upon the increase in the size of exhaust port 30, more exhaust gases are evacuated.

To prevent backdraft when opening 32 is not aligned with exhaust port 30, another enclosure piece 84 is used. Component 84 may have a slight nob 86 at the end portion thereof so that it can be pushed into recess 88 when it becomes aligned with exhaust port 30 by means of an appropriately located extension that coacts therewith. Conversely, a corresponding groove may be provided in the inner circumferential surface of the housing, except at or near exhaust port 30, so that when encountered with the non-grooved surface, closure piece 84 is again pushed into recess 88, so as to allow exhaust gases to be evacuated from chamber 80.

Figure 10:
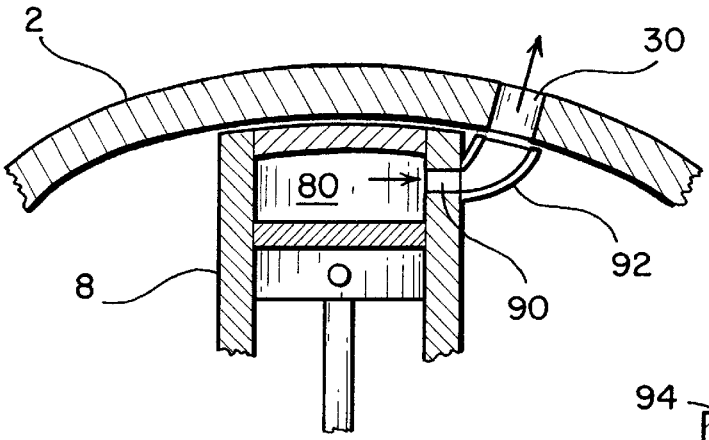
FIG. 10 is a cross-sectional view illustrating another embodiment of the mating of the exhaust opening of the cylinder with an exhaust port of the housing.
Figure 11:
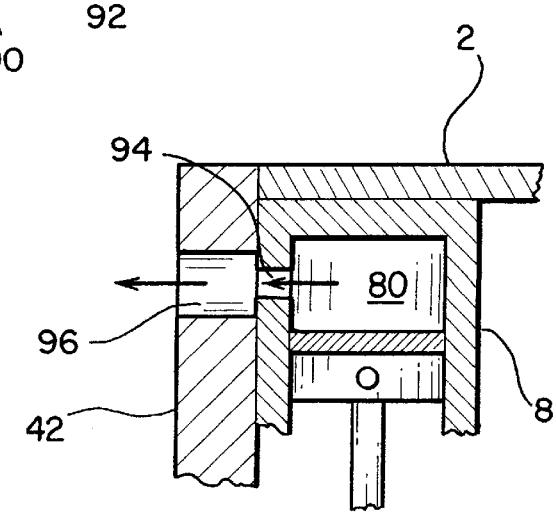
FIG. 11 illustrates yet another exemplar embodiment of exhaust gases being evacuated from the cylinder to the outside environment via an exhaust port of the housing.

FIG. 10 illustrates another way by which exhaust gases are evacuated from chamber 80 of cylinder 8. For this embodiment, note that instead of providing the exhaust opening at the top of cylinder 8, an exhaust opening 90 is provided to the side of substantially the top portion of cylinder 8. An extension 92 is mounted to opening 90 for providing a path through which exhaust gases can be evacuated from chamber 80 through opening 30 out to the environment.

Yet another alternative whereby exhaust gases could be evacuated from the cylinder to the environment is through the housing such as for example by way of cover plate 42 shown in FIG. 2. In particular, an opening 94 is provided to the side of cylinder 8 at a portion thereof that is substantially near the top of chamber 80. A corresponding exhaust port 96 is provided at plate 42 so that once cylinder 8 is, rotated and opening 94 becomes aligned with exhaust port 96, exhaust gases resulting from combustion in chamber 80 are evacuated through opening 94 and exhaust port 96 to the environment.

Note further that instead of a single exhaust opening 94, there could in fact be a number of exhaust openings provided in cylinder 8, provided that those openings are closed when not aligned with exhaust ports, for enhancing the evacuation of the exhaust gases.

FIGS. 12*a*–12*c* are illustrations of the cylinder housing of the instant invention. Assume the cylinder being discussed is 8. As shown in FIG. 12*a*, cylinder 8 is made of a housing having a number of fins 98 for enhancing the cooling of the cylinder, in the event that the engine of the instant invention is an air cooled engine. As best shown in the cross-sectional view of cylinder 8 in FIG. 12*b* and the bottom view of FIG. 12*c*, a number of channels 100 are provided along the inner circumference of the cylinder housing so that the fuel input to crank case 6 (see FIGS. 3 and 6) is fed to chamber 80 of the cylinder.

Figure 9:
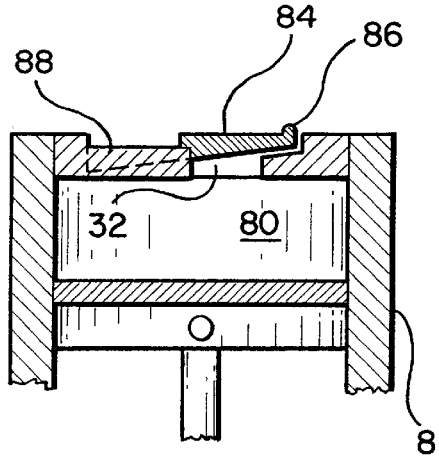
FIG. 9 is a cross-sectional view of an exemplar mechanism for closing the exhaust opening of the cylinder to prevent backdraft when the opening is not aligned with the exhaust port of the housing.

Given that the channels 100 are located at the lower portion of the cylinder while the exhaust opening 32 is located at the top of the cylinder, at the cycle of the operation of the cylinder when exhaust gases are first evacuated from opening 32 and before piston 54 has traveled above the top of channels 100, the fuel from crank case 6 is fed via channels 100 into chamber 80, and in the process, helped to push the exhaust gases out through opening 32. Of course, once piston 54 has been moved within chamber 80 to be above the top of channels 100, no more fuel is provided into chamber 80. At that time, the exhaust gases are assumed to have been evacuated from chamber 80, as cylinder 8 has rotated beyond the particular location where opening 32 is in alignment with exhaust port 30 of housing 2. So, too, at that time, opening 32 is closed by means of component 84 such as shown in FIG. 9, as the compression cycle proceeds in cylinder 8.

FIG. 13 is a perspective view of the crankshaft 102 inside crank case 6 of the engine of the instant invention. As shown, piston rod 16 is coupled to two of the cranks of crank shaft 102, which has coupled to its end driving wheel 20. Plate 104, attached to the other end of crankshaft 102, is configured to match the configuration of opening 52 of extension plate 48 (FIG. 3) so that fuel input to opening 52 is more readily provided into crank case 6 and then by means of channels 100 provided to cylinders 8 and 10.

Figure 14:
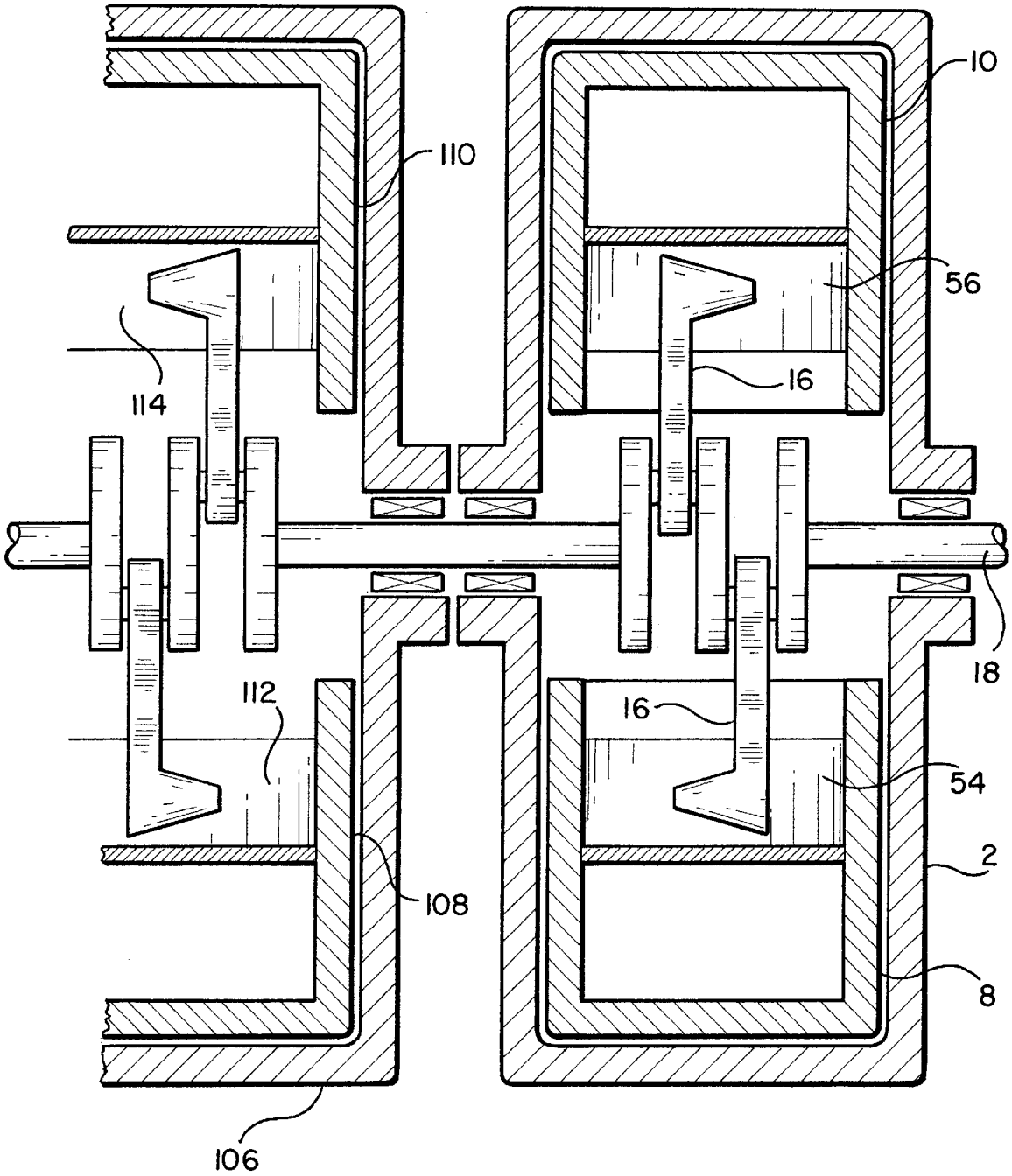
FIG. 14 is an illustration of the stacking of two similar housings to form another embodiment of the engine of the instant invention.

As was mentioned previously, to increase the power of the engine, a number of cylinders may be provided within housing 2. An alternative to increasing the power of the engine of the instant invention is shown in FIG. 14. There, a housing such as 2 having therein cylinders 8 and 10 is cascadedly positioned relative to a similar housing 106 with similar cylinders 108 and 110 therein. Such stacking of housings in effect increases the power of the engine insofar as the single cam shaft 18 is mounted through the stacked housings and is being driven by the reciprocal motions of the respective pistons, such as for example 54, 56 and 112, 114 of the different cylinders. For this embodiment, a corresponding number of exhaust ports and spark plugs are provided in each of the housings so that multiple work cycles may be effected by the various cylinders in each of the housings.

Figure 15:
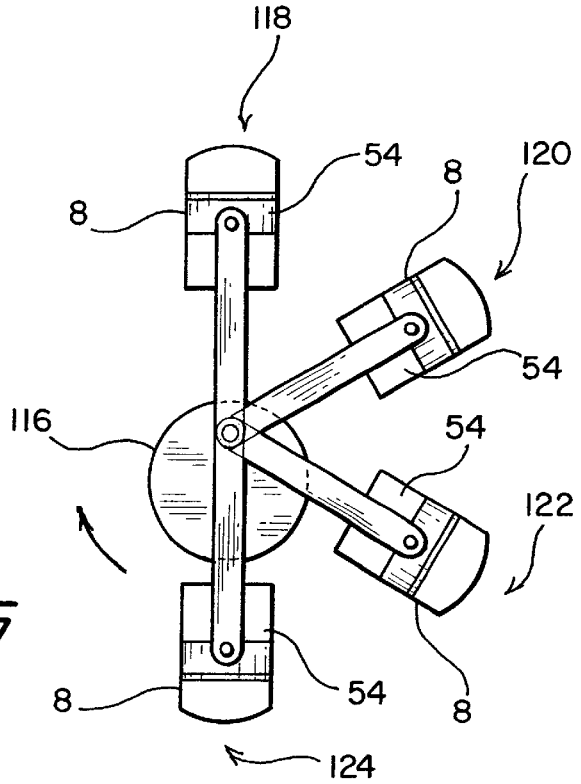
FIG. 15 is a diagram for illustrating a work cycle of a cylinder of the instant invention engine.
Figure 19:
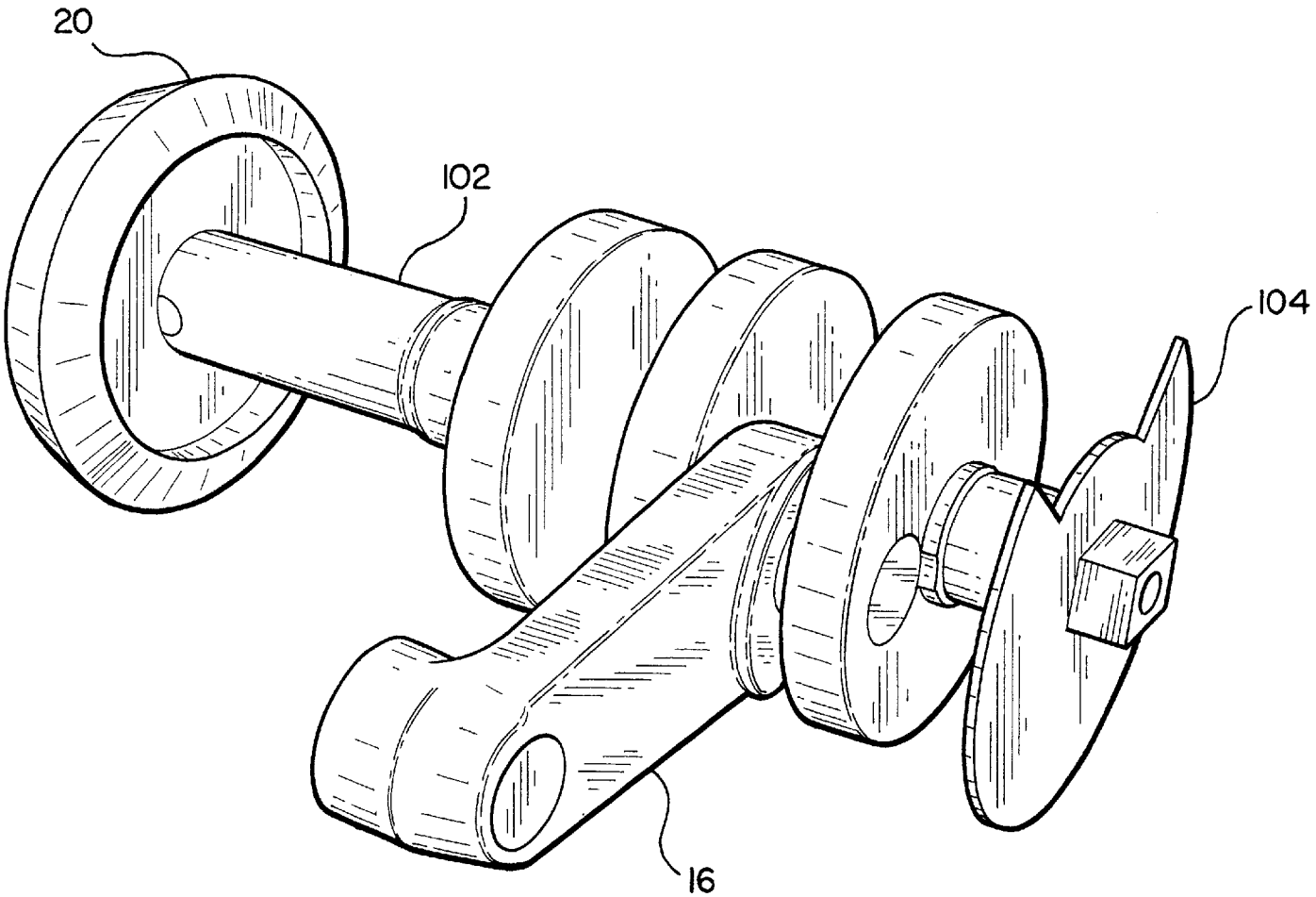

FIG. 15 shows the dynamics of a cylinder, and the piston therein, as it rotates about the crankshaft to which it is mounted per a crank 116. For the embodiment shown in FIG. 15, it is assumed that the crankshaft is fixedly mounted to the frame of the engine. This is feasible in the case of a two cycle engine where, but for the fixedly mounting of the crankshaft, every components of the engine works as before. In other words, the fuel is still being provided by either a carburetor or a fuel injection device into crank case 6, and then provided to the cylinders per the channels integrated to the cylinder housing. Exhaust gases resulting from the combustion within the chamber of the cylinders are still being evacuated through some kind of exhaust opening in the cylinder and corresponding exhaust ports provided in the housing of the engine. As before, the exhaust opening for the cylinder may be provided at either the top of the cylinder or at a location substantially near the top so that exhaust gases are evacuated more efficiently due to the input of the fuel from the lower portion of the cylinder as the compression of the piston takes place.

But with the fixed shaft, there is only one work cycle for a 360° rotation of each cylinder. This is illustrated in FIG. 15 per the four positions of the cylinder 8, and the position of piston 54 in relation therewith. For example, at position 118, piston 54 is in the upmost position. As cylinder 8 rotates to position 120, piston 54 moves lower. At position 122, piston 54 has moved even further down relative to the top portion of cylinder 8. Finally, at position 124, piston 54 has fully moved to its lowest position in cylinder 8. Thus, at position 118, the exhaust gases are evacuated from cylinder 8. And at position 124, fuel is provided to the interior of cylinder 8. A compression cycle then ensues so that only after a 360° rotation has been effected, would cylinder 8 as shown in the embodiment of FIG. 15 effect a single work cycle for a two cycle engine.

Figure 16:
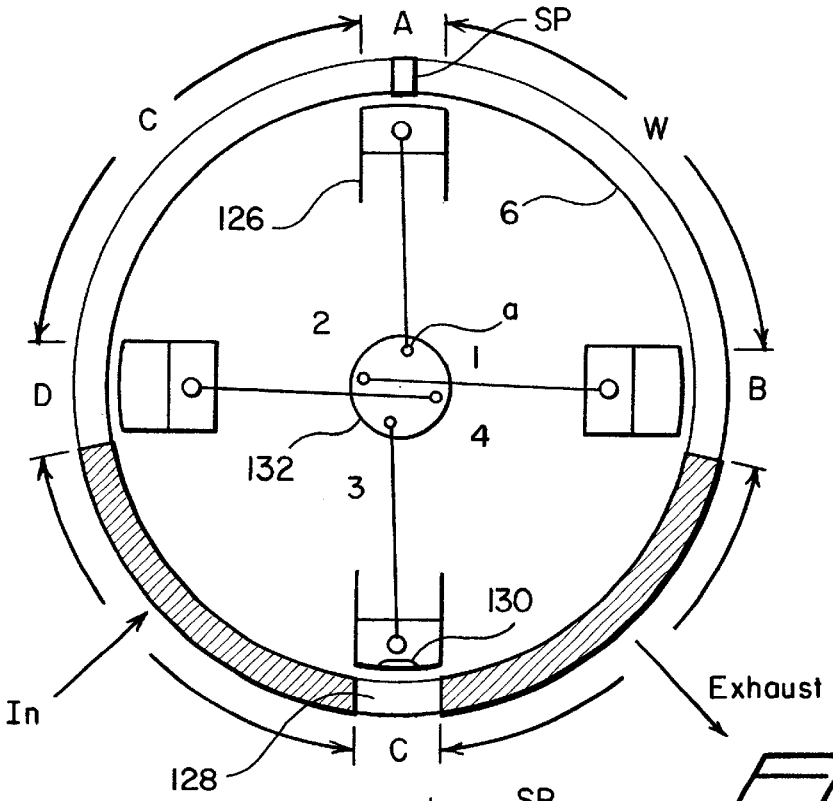
FIG. 16 is an illustration of a four cycle engine of the instant invention having only 1 spark plug and a ratio of 1 to 1.

FIG. 16 shows a four cycle engine with only one spark plug SP, and therefore a gear ratio of 1 to 1. As shown, at position A, cylinder 126 is located relatively close to spark plug SP. When the fuel compressed within the chamber of cylinder 126 is ignited, work results due to the expansion of the gases and the movement of the piston in a downward position relative to the top of cylinder 126. This work cycle is designated W and goes from location A to location B. At location B, the piston of cylinder 126 has been pushed all the way down and the chamber of the cylinder is filled with exhaust gases resulting from the combustion process. Thus, from location B to location C, an exhaust process takes place. Indeed, because exhaust port 128 is located at locations C, the exhaust gases are evacuated from exhaust opening 130 of cylinder 126 through exhaust port 128 of the housing at location C. With the evacuation of the exhaust gases also comes the fueling of the chamber of the cylinder. Such input of fuel takes place between location C and D. For the sake of simplicity, for the FIG. 16 embodiment, assume that cylinder 126 does not have any channels so that no fuel is provided to the chamber as the exhaust gases are being evacuated therefrom. At location D, upon being filled with fuel in the chamber of cylinder 126, the compression process begins as the piston is pushed toward the top of the cylinder so as to compress the fuel inside the chamber of the cylinder. By the time the cylinder reaches location A, the compression process is finished, and the whole process begins anew. Thus, insofar as there is only work cycle for the FIG. 16 illustration, there is a gear ratio of 1 to 1.

With respect to the above discussed FIG. 16 illustration, shaft 132 to which the piston rod of the cylinder is mounted is assumed to rotate in the opposite direction as the rotation of the cylinder about the inner circumferential surface of the housing of the engine.

Consider again the illustration of FIG. 16. For this reconsideration, assume that shaft 132 rotates in the same direction as cylinder 126. The mechanism for effecting a shaft to rotate in the same direction as a cylinder is well known and is taught for example in Cantoni U.S. Pat. No. 2,242,231, the disclosure of which being incorporated by reference herein. Given that the rotational directions of both the shaft and the cylinder are the same, for a 360° revolution of the cylinder, shaft 132 in effect rotates three times as much as cylinder 126. For example, at position A, point a of shaft 132 is located at position 1. Yet when cylinder 126 is rotated to location B, point a of shaft 132 has in fact rotated to position 2. In essence, shaft 132 has rotated three times as much as cylinder 126. Therefore, there is a 3 to 1 ratio if both shaft 132 and cylinder 126 rotate in the same direction. A significant aspect of the instant invention is therefore that both the crankshaft and the cylinder can rotate, either along the same direction or in opposite directions.

As shown in FIG. 16. one work cycle is effected by one cylinder in the engine of the instant invention. For such single cylinder engine, chances are a counter weight is needed 180° from the cylinder. Yet if a second cylinder is provided in the engine opposite to the first cylinder, not only would the number of work cycles increase, the counter weight is also eliminated.

Also to be of note for the four cycle engine embodiment of FIG. 16 is that there is a difference between the four and two cycle engines. For a two cycle engine, the fuel and the exhaust gases both can go out along the same direction so that fuel can be fed through the lower portion of the cylinders to force the exhaust gases out. However, in the case of a four cycle engine, both the fuel and exhaust gases can use the same openings, but at opposite directions. In other words, for a first time period, exhaust gases are being evacuated. For the next time period, fuel is being input. But in either case, for the instant invention engine, be it a two cycle or four cycle engine, the one thing that remains constant is that no valves are needed, as exhaust gases are evacuated due to the alignment of the exhaust opening in the cylinder with the exhaust port in the housing, as the cylinder is rotated about the crankshaft.

Figure 17:
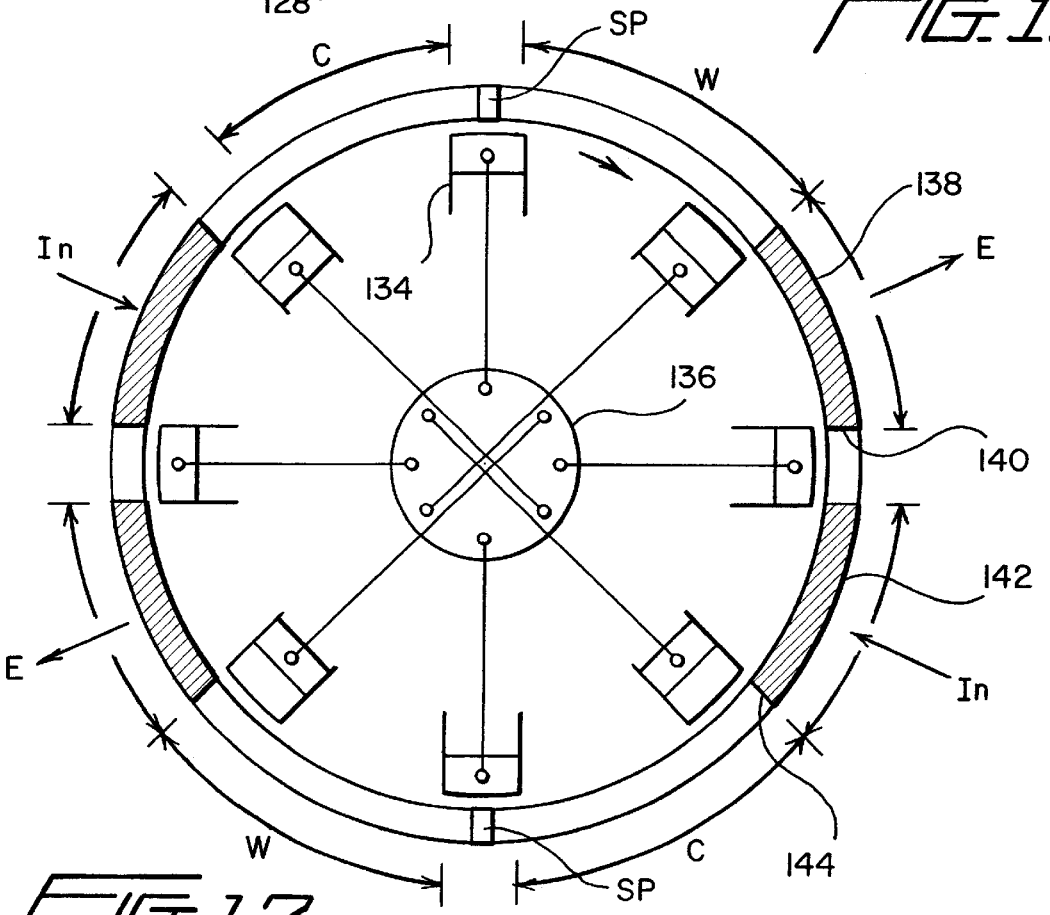
FIG. 17 is an illustration of yet another four cycle engine of the instant invention that operates with more than one spark plugs for effecting multiple work cycles.

FIG. 17 shows a four cycle engine that has two spark plugs. Thus, for every cylinder provided in the FIG. 17 engine, there will be two work cycles for every 360° rotation. Such is indicated by the eight different locations of cylinder 134 as it rotates in a direction counter to that of crankshaft 136. The interesting thing to note for the FIG. 17 embodiment is that the exhaust port, if fitted with the appropriate closure component, begins to open at approximately point 138 and opens completely at point 140. Similarly, the input of the fuel begins at approximately point 142 and ends at point 144, before the compression cycle begins. Thus, for the exemplar four cycle engine of FIG. 17, each cylinder provided within the engine housing performs two work cycles per 360° revolution. Thus, if there are two cylinders provided within the engine housing of FIG. 17, four work cycles would result. Continuing, if four cylinders are provided in the engine housing, then there would be eight work cycles for every 360° revolution. Thus, if a sufficiently large engine housing is provided with the appropriate number of spark plugs and exhaust ports, a multiple cylinder engine that operates efficiently with ample power output can be obtained. Furthermore, the instant invention not only is adapted to work as a two cycle engine, it can also work as a four cycle engine.

Inasmuch as the present invention is subject to many variations, modifications and changes in detail, it is intended that all matter described throughout this specification and shown in the accompanying drawings be interpreted as illustrative only and not in a limiting sense. Accordingly, it is intended that the invention be limited only the spirit and scope of the hereto appended claims.

What is claimed is:

1. An internal combustion engine, comprising:

at least one housing having an inner circumferential surface;

a crankcase;

a crankshaft extending from said crankcase;

at least one cylinder positioned in said housing having its top portion rotatable substantially along said circumferential surface, said cylinder having a chamber and a piston movable longitudinally therein, a piston rod connecting said piston and extending from said cylinder to movably mount to said crankshaft so that said cylinder is rotatable about said crankshaft;

at least one exhaust port formed in said housing to effect a passageway from the inside to the outside of said housing;

at least one opening formed in said cylinder to enable gases in the chamber of said cylinder to be evacuated therefrom; and at least one channel formed at said cylinder through which fuel is fed into said chamber of said cylinder via said crankcase in an amount that relates to the positioning of said piston in said chamber;

wherein when said cylinder is rotated to a particular portion along said circumferential surface, exhaust gases resulting from combustion in said chamber of said cylinder are evacuated through said one opening of said cylinder and said exhaust port of said housing to the outside of said housing.

2. The engine of claim 1, wherein said cylinder further comprises a second channel through which fuel is fed into the chamber of said cylinder.

3. The engine of claim 1, further comprising:

an other housing having an inner circumferential surface;

at least one other cylinder positioned in said other housing, said other cylinder having a chamber and a piston movable longitudinally therein, said piston having extending therefrom a piston rod movably mounted to said crankshaft so that said other cylinder is rotatable about said crankshaft;

at least one opening formed in said other cylinder to enable exhaust gases therein to escape therefrom;

said one and other housings being positioned relative to and working cooperatively with each other so that said one and other cylinders are rotated in unison, said one and other cylinders being rotated to respective locations along said corresponding circumferential surfaces to enable exhaust gases from said one and other cylinders to be evacuated from said respective openings formed in said cylinders and the corresponding exhaust ports in said one and other housings.

4. The engine of claim 1, further comprising:

at least two cylinders positioned opposed to each other, each of said cylinders having a piston movable longitudinally therein and a piston rod extending therefrom movably coupled to said crankshaft so that said cylinders are rotatable at 180 degrees about said crankshaft.

5. The engine of claim 1, wherein said cylinder is rotated in a first direction relative to said crankshaft; and wherein said crankshaft is driven by said cylinder to rotate in a direction opposite to said first direction.

6. The engine of claim 1, wherein said crankshaft is fixedly coupled to a frame, further comprising:

drive gear means directly coupled to either said frame or said cylinder so as to be movable with the rotation of said cylinder.

7. The engine of claim 1, wherein said crankshaft is fixedly mounted to a frame, said engine further comprising:

drive means operationally connected to either said frame or said cylinder so as to be driven by said cylinder as it rotates about said crankshaft.

8. A valveless engine, comprising:

a crankshaft;

at least one cylinder rotatably coupled to said crankshaft, relative rotation being effected between said cylinder and said crankshaft;

at least one opening in said cylinder wherefrom exhaust gases resulting from combustion in said cylinder can escape;

a housing having an inner circumferential surface whereon said cylinder is movable about includes at least one exhaust port to mate with said opening of said cylinder at least once for every revolution of said cylinder about said inner circumferential surface of said housing to effect a passageway for the exhaust gases in said cylinder to be evacuated therefrom; and at least one channel formed at the lower portion of said cylinder through which fuel provided to an area below said cylinder is fed into said cylinder in an amount corresponding to the positioning of said cylinder in relation to its rotation relative to said crankshaft.

9. The engine of claim 8, further comprising:

a crankcase wherefrom said one cylinder extends and whereinto fuel for said cylinder is fed from an input port;

wherein said at least one channel is formed at the portion of said cylinder away from said opening through which fuel is input to said cylinder; and wherein said one cylinder comprises at least an other channel through which fuel is fed into said cylinder.

10. The engine of claim 9, further comprising:

at least one input port at said housing for enabling the fuel to be supplied through said channel to said cylinder when or after a substantial portion of the exhaust gases are being evacuated.

11. The engine of claim 8, further comprising:

another cylinder positioned opposed to said one cylinder so that said one and other cylinders are rotatable at 180 degrees about said crankshaft.

12. The engine of claim 8, wherein said cylinder is rotated in a first direction relative to said crankshaft; and wherein said crankshaft is driven by said cylinder to rotate in a direction opposite to said first direction.

13. The engine of claim 8, further comprising:

a plurality of exhaust ports formed at said housing and positioned relative to said cylinder; and at least one channel formed at said cylinder wherethrough the fuel is input to said cylinder while exhaust gases resulting from combustion of said fuel in said cylinder are evacuated via each of said exhaust ports as said cylinder rotates about said crankshaft, so that said cylinder effects a plurality of work cycles per each full revolution it makes relative to said crankshaft.

14. The engine of claim 8, further comprising:

at least an other cylinder positioned relative to said one cylinder rotatably coupled to said crankshaft;

at least one opening in said other cylinder wherefrom exhaust gases resulting from combustion in said other cylinder can escape; and at least an other exhaust port formed at said housing positioned relative to said other cylinder to mate with said opening of said other cylinder at least once for every revolution of said other cylinder about said crankshaft;

wherein said other cylinder works cooperatively with said one cylinder to provide additional output power from said engine.

15. The engine of claim 8, further comprising:

a gear mechanism having a first gear cooperatively rotatable with the rotation of said cylinder about said crankshaft;

a second gear cooperatively rotatable with the rotation of said crankshaft;

a synchronizing gear movably coupling said first gear to said second gear; and a drive shaft fixedly coupled to said synchronizing gear so as to be rotatable with the rotation of said synchronizing gear.

16. The engine of claim 15, Wherein said first and second gears rotate in opposite directions.

17. A valveless engine comprising:

a crankcase;

a crankshaft movably extending from said crankcase;

a plurality of cylinders extending from said crankcase each movably coupled and rotatable relative to said crankshaft;

at least one opening in each of said cylinders wherefrom exhaust gases resulting from combustion in said each cylinder can escape;

a housing having an inner circumferential surface whereon said cylinders are movable, said housing further having a plurality of exhaust ports each positioned relative to a corresponding one of said cylinders so that said each exhaust port is aligned with said one opening of said one cylinder at least once for every revolution of said one cylinder about said crankshaft to enable the exhaust gases in said one cylinder to be evacuated therefrom; and at least one channel in fluid communication with said crankcase formed at each of said cylinders away from said one opening to enable fuel to be fed into each of said cylinders to enhance the evacuation of the exhaust gases from said each cylinder as said each cylinder rotates about said crankshaft.

18. The engine of claim 17, further comprising:

at least one input port at said crankcase for enabling the fuel to be supplied to said cylinders through the one channel of said each cylinder.

19. The engine of claim 17, wherein said one channel is provided at substantially the lower portion of said each cylinder while said opening is provided at substantially the upper portion of said each cylinder; and wherein each of said cylinders comprises at least an other channel.

20. The engine of claim 17, further comprising:

a plurality of fuel input ports at said housing each positioned relative to a corresponding one of said cylinders to input fuel to said one cylinder while exhaust gases resulting from combustion of said fuel in said one cylinder are evacuated from the exhaust port aligned with said one cylinder as said one cylinder rotates about said crankshaft, said plurality of cylinders effecting a plurality of work cycles per each full revolution a leading one of said plurality of cylinders makes about said crankshaft.

21. The engine of claim 17, further comprising:

a plurality of housings workingly coupled to each other, said housings each having positioned therein at least one of said plurality of cylinders, said cylinders working cooperatively to effect a multiple work cycle engine.

22. A method of increasing the efficiency of an internal combustion engine, comprising the steps of:

a) coupling a crankshaft movably extending from a crankcase to a frame of said engine;

b) movably mounting at least one cylinder via its piston rod about said crankshaft in a housing;

c) effecting at least one opening to said cylinder to allow exhaust gases resulting from combustion therein to escape;

d) forming at least one exhaust port in said housing in proximate relationship to said cylinder;

e) effecting a relative rotational movement between said cylinder and said crankshaft to align said exhaust port with said opening to thereby evacuate the exhaust gases from said cylinder; and f) providing at least one channel at said cylinder away from said one opening to enable fuel to be fed to said cylinder via said crankcase in an amount in proportion to the rotational positioning of said cylinder relative to said crankshaft.

23. Method of claim 22, further comprising the step of:

providing at least one other channel in said cylinder for inputting fuel to said cylinder.

24. Method of claim 22, wherein said step (e) further comprises the step of:

effecting said crankshaft to rotate in a direction opposite to the rotation of said cylinder.

25. Method of claim 22, further comprising the steps of:

providing a first gear to cooperatively rotate with the rotation of said cylinder about said crankshaft;

providing a second gear to cooperatively rotate with the rotation of said crankshaft;

providing a synchronizing gear to movably couple said first gear to said second gear; and fixedly coupling a drive shaft to said synchronizing gear so that said drive shaft is rotatable with the rotation of said synchronizing gear.

26. Method of claim 25, further comprising the step of;

effecting said first and second gears to rotate in opposite directions.

27. Method of claim 22, further comprising the step of:

positioning an other cylinder opposed to said one cylinder so that said one and other cylinders are rotatable at 180 degrees about said crankshaft.

28. Method of claim 22, further comprising the steps of:

positioning a plurality of exhaust ports relative to said cylinder;

positioning a plurality of fuel input ports relative to said cylinder;

supplying fuel to said cylinder via each of said fuel input ports while evacuating exhaust gases resulting from combustion of said fuel in said cylinder via each of said exhaust ports as said cylinder rotates about said crankshaft for effecting said cylinder effects to perform a plurality of work cycles per each full revolution it makes about said crankshaft.

29. Method of claim 22, further comprising the step of:

rotatably coupling to said crankshaft at least an other cylinder positioned relative to said one cylinder;

providing at least one opening in said other cylinder wherefrom exhaust gases resulting from combustion in said other cylinder can escape; and mating at least an other exhaust port positioned relative to said other cylinder with said opening of said other cylinder at least once for every revolution of said other cylinder about said crankshaft;

wherein said other cylinder works cooperatively with said one cylinder to provide additional output power from said engine.

30. The method of claim 22, further comprising the step of:

closing said one opening of said cylinder when said cylinder is not mated to said exhaust port.

31. Method of claim 22, wherein said crankshaft is fixedly coupled to said frame and wherein said step e further comprises the step of rotating said cylinder about said crankshaft, said method further comprising the step of:

operatively coupling a drive shaft to said cylinder so that said drive shaft rotates in unison with said cylinder.

32. Method of claim 22, wherein said step (e) further comprises the step of:

effecting said crankshaft to rotate in the same direction as the rotation of said cylinder.

33. Method of claim 22, further comprising the step of:

adjusting the size of the opening of said exhaust port of said cylinder to control the power output from said cylinder.

* * * * *